US011365858B2

(12) United States Patent
Li et al.

(10) Patent No.: US 11,365,858 B2
(45) Date of Patent: Jun. 21, 2022

(54) LIGHTING MODULE, VEHICLE LAMP AND VEHICLE

(71) Applicant: HASCO VISION TECHNOLOGY CO., LTD., Shanghai (CN)

(72) Inventors: Cong Li, Shanghai (CN); Zhiping Qiu, Shanghai (CN); He Zhu, Shanghai (CN); Wenhui Sang, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/264,629

(22) PCT Filed: Oct. 25, 2019

(86) PCT No.: PCT/CN2019/113229
§ 371 (c)(1),
(2) Date: Jan. 29, 2021

(87) PCT Pub. No.: WO2020/083361
PCT Pub. Date: Apr. 30, 2020

(65) Prior Publication Data

US 2021/0310628 A1 Oct. 7, 2021

(30) Foreign Application Priority Data

Oct. 25, 2018 (CN) ..... 201811248104.9
May 21, 2019 (CN) ..... 201920738614.8

(51) Int. Cl.
*F21V 9/00* (2018.01)
*F21S 41/24* (2018.01)
(Continued)

(52) U.S. Cl.
CPC ..... *F21S 41/24* (2018.01); *F21S 41/663* (2018.01); *F21S 45/47* (2018.01); *F21W 2102/13* (2018.01)

(58) Field of Classification Search
CPC ..... F21S 41/24; F21S 43/237; F21S 43/241; F21S 43/235; F21S 41/151; F21S 41/153;
(Continued)

(56) References Cited

U.S. PATENT DOCUMENTS

2008/0198574 A1 8/2008 Woodward et al.
2008/0253144 A1* 10/2008 Dolson ..... B60Q 1/0041 362/547
(Continued)

FOREIGN PATENT DOCUMENTS

AT 517523 A1 2/2017
CN 101132950 A 2/2008
(Continued)

OTHER PUBLICATIONS

International Search Report for PCT/CN2019/113229 dated Jan. 23, 2020.
(Continued)

*Primary Examiner* — Omar Rojas Cadima
(74) *Attorney, Agent, or Firm* — McNees Wallace & Nurick LLC

(57) ABSTRACT

Disclosed are a lighting module, a vehicle lamp and a vehicle. The lighting module includes a plurality of high-beam light sources, a plurality of low-beam light sources, a high-beam optical element and a low-beam optical element. The high-beam optical element includes a plurality of high-beam light guide bodies, which are in one-to-one correspondence with the plurality of high-beam light sources. The low-beam optical element includes at least one low-beam light guide body, the plurality of low-beam light sources are disposed at a rear end of the at least one low-beam light guide body, and a front end of the at least one low-beam light guide body forms a continuous low-beam light emitting surface. The low-beam optical element and the high-beam
(Continued)

optical element are disposed one above the other, an upper boundary of the high-beam light emitting surface.

22 Claims, 12 Drawing Sheets

(51) Int. Cl.
*F21S 41/663* (2018.01)
*F21S 45/47* (2018.01)
*F21W 102/13* (2018.01)

(58) Field of Classification Search
CPC ..... F21S 41/143; F21S 41/141; F21S 43/14; F21S 43/27; G02B 6/0028; G02B 6/00; G02B 19/0061; G02B 6/0076; G02B 6/0078; B60Q 1/0011; B60Q 1/0041; B60Q 1/2607; B60Q 2300/056; B60Q 1/24; B60Q 1/18; B60Q 1/04; B60Q 1/0047; F21Y 2115/10; F21Y 2105/10; F21Y 2105/12; F21Y 2103/10; F21K 9/00; H05K 2203/167; H05K 2201/10522; F21V 17/108; F21V 17/12; F21V 17/14; F21W 2103/00; F21W 2102/00; F21W 2107/10; F21W 2102/13
See application file for complete search history.

(56) References Cited

U.S. PATENT DOCUMENTS

| | | | | |
|---|---|---|---|---|
| 2009/0016074 | A1* | 1/2009 | Dolson | F21K 9/00 362/555 |
| 2013/0250599 | A1 | 9/2013 | Owada | |
| 2016/0304025 | A1 | 10/2016 | King | |
| 2017/0089536 | A1 | 3/2017 | Courcier et al. | |
| 2017/0234503 | A1 | 8/2017 | Buffone et al. | |
| 2018/0087733 | A1 | 3/2018 | Hermitte et al. | |
| 2018/0313511 | A1* | 11/2018 | Lee | F21S 41/24 |

FOREIGN PATENT DOCUMENTS

| | | | | |
|---|---|---|---|---|
| CN | 202813153 | U | 3/2013 | |
| CN | 204328773 | U | 5/2015 | |
| CN | 106122870 | A | 11/2016 | |
| CN | 106122876 | A | 11/2016 | |
| CN | 106439672 | A | 2/2017 | |
| CN | 106871037 | A | 6/2017 | |
| CN | 107327784 | A | 11/2017 | |
| CN | 107664290 | A | 2/2018 | |
| CN | 108072009 | A | 5/2018 | |
| CN | 207334613 | U | 5/2018 | |
| CN | 108139059 | A | 6/2018 | |
| CN | 207539826 | U | 6/2018 | |
| CN | 108397746 | A | 8/2018 | |
| CN | 108534078 | A | 9/2018 | |
| CN | 108613104 | A | 10/2018 | |
| CN | 108692256 | A | 10/2018 | |
| CN | 207962511 | U | 10/2018 | |
| CN | 109268774 | A | 1/2019 | |
| CN | 209026719 | U | 6/2019 | |
| CN | 210107257 | U | 2/2020 | |
| JP | 2004094115 | A | 3/2004 | |
| JP | 2008533726 | A | 8/2008 | |
| JP | 2010519696 | A | 6/2010 | |
| JP | 2011129282 | A | 6/2011 | |
| JP | 2015013512 | A | 1/2015 | |
| JP | 2015523677 | A | 8/2015 | |
| WO | WO-2013166535 | A2 * | 11/2013 | G02B 6/0008 |
| WO | WO-2018149407 | A1 * | 8/2018 | F21S 41/29 |

OTHER PUBLICATIONS

Office Action issued to Japanese counterpart Application No. JP2021-511558.

Office Action issue to Chinese counterpart Application No. CN201980037648.7.

* cited by examiner

LIGHTING MODULE, VEHICLE LAMP AND VEHICLE

CROSS-REFERENCE TO RELATED APPLICATIONS

This is a National Stage Application, filed under 35 U.S.C.371, of International Patent Application number PCT/CN2019/113229, filed on Oct. 25, 2019, which claims priority to Chinese Patent Application No. 201811248104.9 filed on Oct. 25, 2018 and Chinese Patent Application No. 201920738614.8 filed on May 21, 2019, the contents of which are incorporated herein by reference in their entireties.

TECHNICAL FIELD

This application relates to the technical field of vehicle lamps, for example, to a lighting module, a vehicle lamp and a vehicle which include the lighting module.

BACKGROUND

At present, vehicles are an indispensable means of transportation for humans. In the process of using vehicles, we may encounter special situations such as foggy days and nights in which people may have poor vision. In these situations, the use of lighting tools can help a driver to observe surrounding road conditions and remind vehicles or pedestrians on the opposite side, so that traffic accidents can be reduced.

In a lighting module in the related art, a reflector is used as a primary optical element. The light utilization rate of the reflector is relatively low, and the size of the reflector is relatively large, which indirectly increases the volume of the lighting module, so that customer requirements cannot be satisfied.

In addition, in the related art, the installation structure of the lighting module is relatively complicated, the positioning of the parts is not accurate enough, and the positioning is relatively difficult, which affects the accuracy of the vehicle lamp optical system thereby affecting the lighting effect on the road.

SUMMARY

The present application provides a lighting module, a vehicle lamp and a vehicle. The lighting module has a small volume, high installation accuracy and high light utilization rate, so that a desired light shape of the vehicle lamp can be obtained.

The application adopts the solutions described below.

A lighting module includes a plurality of high-beam light sources, a plurality of low-beam light sources, a high-beam optical element and a low-beam optical element.

The high-beam optical element includes a plurality of high-beam light guide bodies, the plurality of high-beam light guide bodies are in one-to-one correspondence with the plurality of high-beam light sources, rear ends of the plurality of high-beam light guide bodies are separated from one another, and front ends of the plurality of high-beam light guide bodies are connected in sequence to form a continuous high-beam light emitting surface.

The low-beam optical element includes at least one low-beam light guide body. The plurality of low-beam light sources are disposed at a rear end of the at least one low-beam light guide body, and a front end of the at least one low-beam light guide body forms a continuous low-beam light emitting surface.

The low-beam optical element and the high-beam optical element are disposed one above the other, an upper boundary of the high-beam light emitting surface and a lower boundary of the low-beam light emitting surface are fit or a spacing distance between an upper boundary of the high-beam light emitting surface and a lower boundary of the low-beam light emitting surface in an up-and-down direction is less than or equal to 2 mm.

This application further provides a vehicle lamp including the lighting module provided in any one of the preceding solutions.

This application further provides a vehicle including the vehicle lamp provided in the preceding solutions.

REFERENCE LIST

Figure 1:
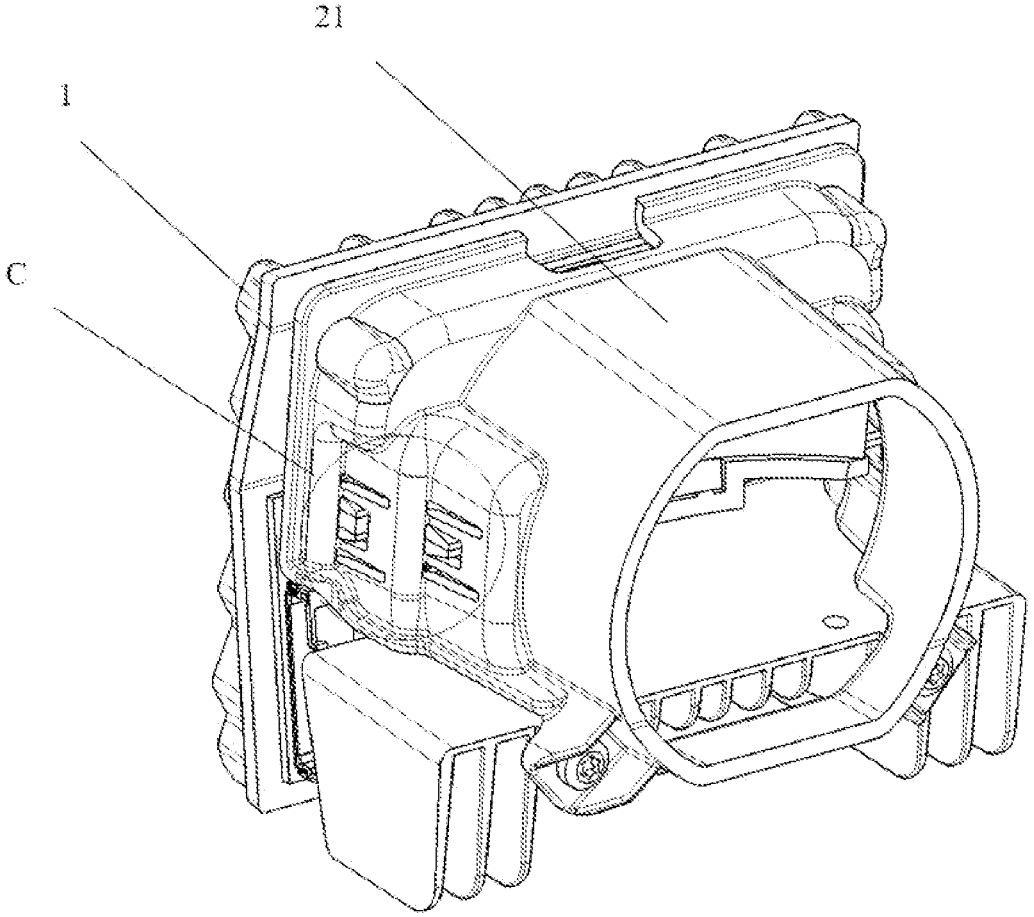
FIG. 1 is a view of a lighting module (without a lens) according to a first embodiment of this application.
Figure 2:
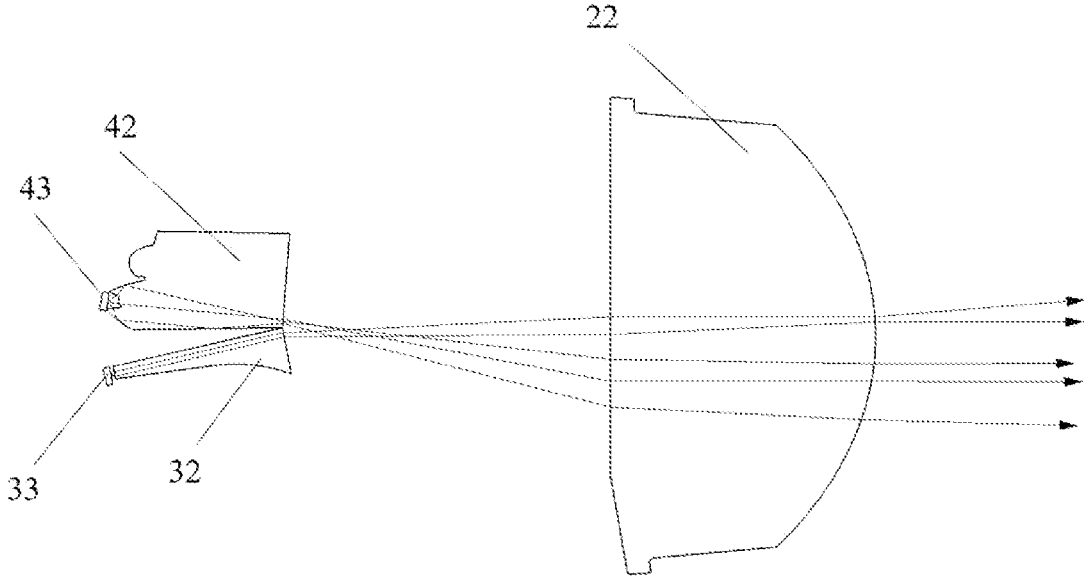
FIG. 2 is a diagram illustrating the light path of the lighting module according to the first embodiment of this application.
Figure 3:
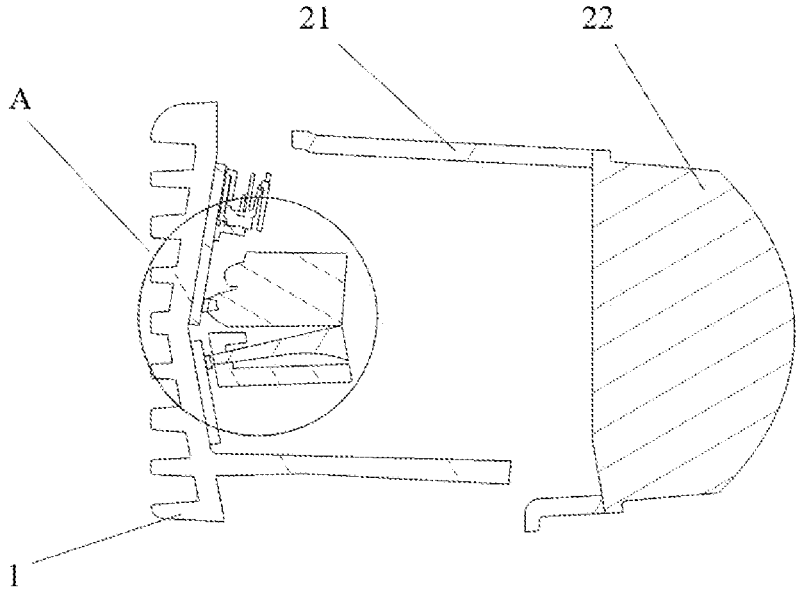
FIG. 3 is a sectional view of the lighting module according to the first embodiment of this application.
Figure 4:
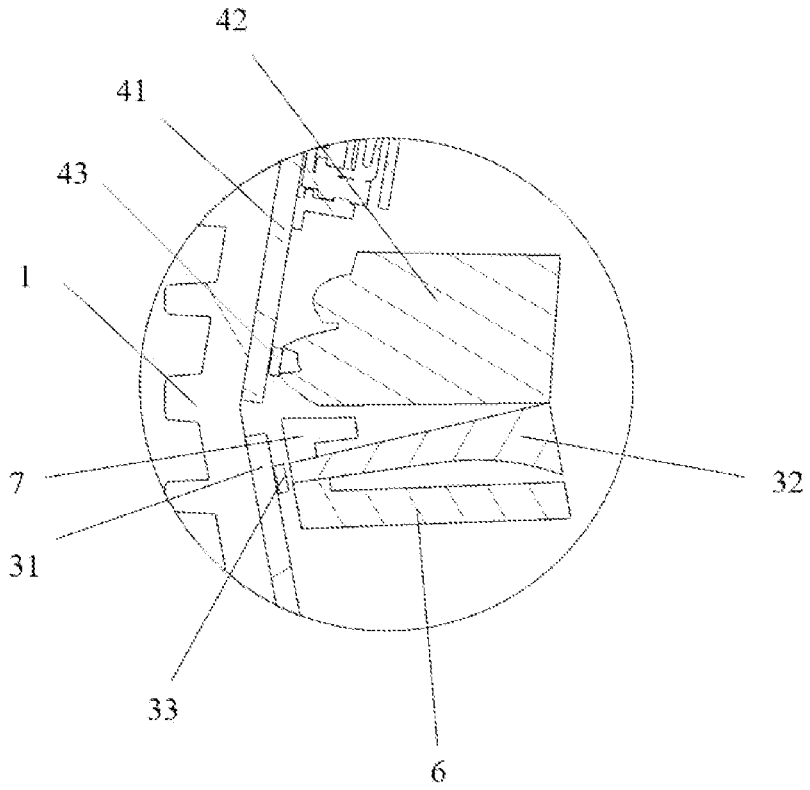
FIG. 4 is a partial enlarged view of FIG. 3 at position A.

1 heat sink
11 fourth positioning hole
12 third mounting hole
21 lens holder
211 first clamping hole
212 second clamping hole
213 opening
22 lens
23 lens collar
31 high-beam circuit board
32 high-beam optical element
321 high-beam light incident part
322 high-beam light passing part
3221 first positioning hole
323 high-beam light emitting surface
33 high-beam light source
41 low-beam circuit board
42 low-beam optical element
421 low-beam light incident part
422 low-beam light passing part
423 low-beam light emitting surface
424 mounting lug
4241 first mounting hole
43 low-beam light source
51 second positioning pin
52 first positioning pin
53 first fastener
54 second fastener
6 supporting member
61 groove
62 first positioning protrusion
63 second positioning protrusion
64 rectangular hole
641 separation rib
65 positioning part
66 engaging part
67 fourth positioning pin
7 pressing plate
71 third positioning protrusion
72 fourth positioning protrusion
73 positioning groove
74 third positioning pin
75 buckle structure
81 first clamping leg
82 second clamping leg
83 third clamping leg
84 fourth clamping leg
85 fifth clamping leg
91 circuit board
92 connecting rib
93 flange

DETAILED DESCRIPTION

Solutions in embodiments of the present disclosure will be further described below in detail in conjunction with the drawings.

In the description of this application, it is to be noted that, in the case of no explanation to the contrary, the orientation or position relationship indicated by the orientation words such as "up", "down", "left", "right", "front" and "rear" are based on the orientation or position relationship indicated by the direction of a vehicle in a normal driving state after a lighting module and a vehicle lamp of this application are installed on the vehicle, and are merely for facilitating the description of this application and simplifying the description, rather than indicating or implying that the pointed apparatus or element must have a specific orientation, be constructed and operated in a specific orientation, and therefore cannot be construed as a limitation of this application. In addition, terms such as "first" and "second" are used merely for the purpose of description and are not to be construed as indicating or implying relative importance. For example, terms "first position" and "second position" are two different positions.

In the description of this application, it is to be noted that terms "mounted", "joined" and "connected" are to be understood in a broad sense unless otherwise expressly specified and limited. For example, the term "connected" may refer to "securely connected" or "detachably connected", may refer to "mechanically connected" or "electrically connected" or may refer to "connected directly", "connected indirectly through an intermediary" or "connected in two components". For those of ordinary skill in the art, the preceding terms in this application can be construed depending on specific contexts.

This application provides a lighting module. The lighting module includes a plurality of high-beam light sources 33, a plurality of low-beam light sources 43, a high-beam optical element 32 and a low-beam optical element 42. The high-beam optical element 32 includes a plurality of high-beam light guide bodies, and the plurality of high-beam light guide bodies are in one-to-one correspondence with the plurality of high-beam light sources 33. Rear ends of the plurality of high-beam light guide bodies are separated from one another, and front ends of the plurality of high-beam light guide bodies are sequentially connected to form a continuous high-beam light emitting surface 323. The low-beam optical element 42 includes at least one low-beam light guide body. The plurality of low-beam light sources 43 are disposed at a rear end of the at least one low-beam light guide body, and a front end of the at least one low-beam light guide body forms a continuous low-beam light emitting surface 423. The low-beam optical element 42 and the high-beam optical element 32 are disposed one above the other. An upper boundary of the high-beam light emitting surface 323 is attached to a lower boundary of the low-beam light emitting surface 423; alternatively, a spacing distance between the upper boundary of the high-beam light emitting surface 323 and the lower boundary of the low-beam light emitting surface 423 in an up-and-down direction is less than or equal to 2 mm.

A shape of the lower boundary of the low-beam light emitting surface 423 adapts to a shape of a low-beam cut-off line, and a shape of the upper boundary of the high-beam light emitting surface 323 adapts to a shape of a high-beam cut-off line. It is to be noted that the low-beam cut-off line and the high-beam cut-off line are both cut-off lines defined in the relevant laws and regulations of vehicle lamps and are terms well known to those skilled in the art. The shape of the cut-off line can be configured according to the required boundary shape of the light shape.

Compared with a primary optical element adopting a reflector in the related art, the lighting module provided in this application has a smaller volume and a more compact structure to satisfy the requirements of a user. The high-beam optical element 32 adopts the plurality of high-beam light guide bodies to achieve an anti-glare high beam function. The low-beam optical element 42 may be provided with one or more low-beam light guide bodies according to the actual requirements of the lighting module, in a case where one low-beam light guide body is adopted, the structure is stable and simple so that the ordinary low-beam function can be achieved; and in a case where the plurality of low-beam light guide bodies are adopted, some auxiliary functions of the low beam can be achieved. In this application, the low-beam optical element 42 and the high-beam optical element 32 are adopted, which greatly increases the light utilization rates of the low-beam light sources 43 and the high-beam light sources 33; the upper boundary of the high-beam light emitting surface 323 is attached to the lower boundary of the low-beam light emitting surface 423 or a very small space exists between the upper boundary of the high-beam light emitting surface 323 and the lower boundary of the low-beam light emitting surface 423, so that a good connection between the low-beam light shape and the high-beam light shape can be ensured and the phenomenon of dark areas or uneven light shape transitions can be avoided.

In a specific embodiment of this application, as shown in FIGS. 1 to 15, the lighting module further includes a supporting member 6, which is provided with a groove 61. The high-beam optical element 32 is disposed in the groove 61, a pressing plate 7 is disposed above the high-beam optical element 32, and the low-beam optical element 42 is disposed above the pressing plate 7.

The lighting module further includes a lens holder 21, which is provided with a lens 22. In a lighting module in the related art, the optical elements are usually securely mounted on a heat sink 1, and the lens 22 is connected to the lens holder 21 and then securely mounted on the heat sink 1 or securely mounted on the heat sink 1 through a transition holder, so that the relative position accuracy between the optical elements and the lens 22 is affected by a plurality of secure installation errors, and thus the relative position accuracy is relatively low, which affects the accuracy of the vehicle lamp optical system.

Figure 14:
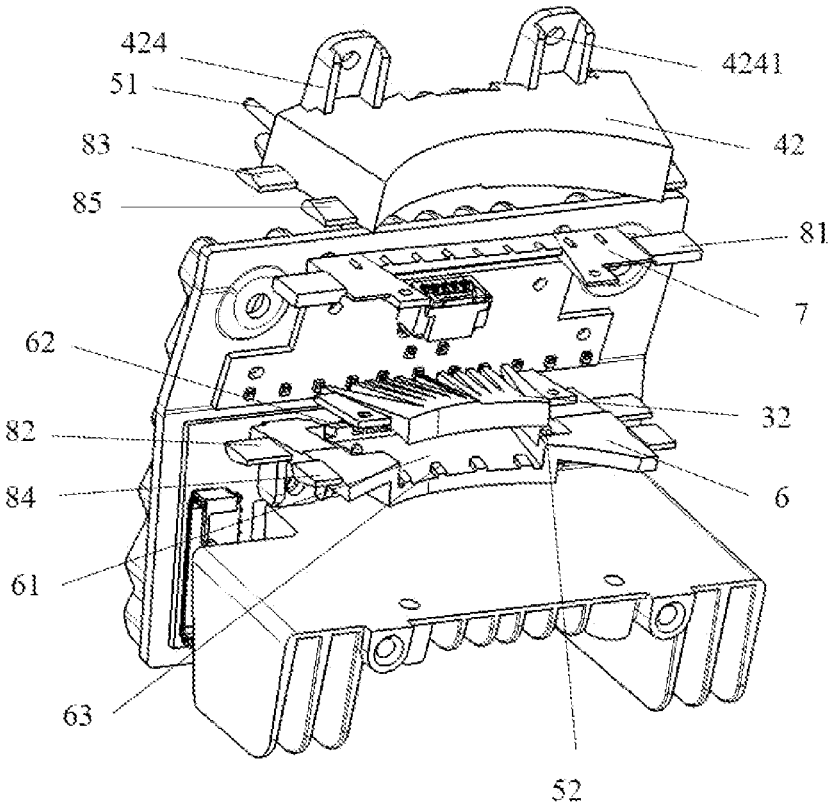
FIG. 14 is an exploded view of the lighting module (excluding the lens holder and the lens) according to the first embodiment of this application.
Figure 15:
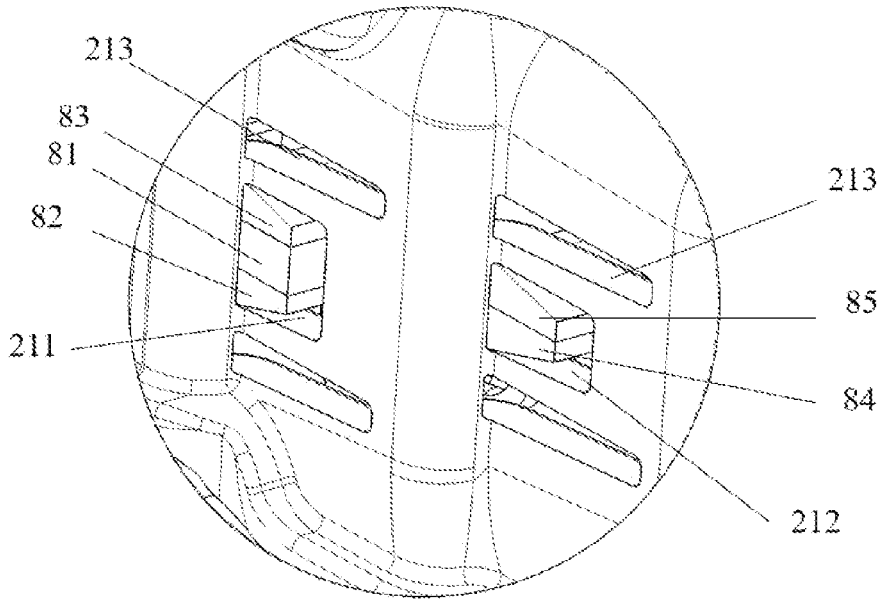
FIG. 15 is a partial enlarged view of FIG. 1 at position C.

Therefore, in an embodiment, in order to reduce the number of installation errors between the optical elements and the lens 22 and improve the relative position accuracy between the optical elements and the lens 22, as shown in FIG. 14, left and right sides of the pressing plate 7 are respectively provided with a first clamping leg 81, left and right sides of the supporting member 6 are respectively provided with a second clamping leg 82 which is directly opposite to the first clamping leg 81, and left and right sides of the low-beam optical element 42 are respectively provided with a third clamping leg 83 which is directly opposite to the first clamping leg 81 and the second clamping leg 82. As shown in FIG. 15, left and right sides of the lens holder 21 are respectively provided with a first clamping hole 211, and the third clamping leg 83, the first clamping leg 81 and the second clamping leg 82 located on the same side are sequentially stacked from top to bottom and clamped in the first clamping hole 211, so that the pressing plate 7, the supporting member 6 and the optical element are connected to the lens holder 21.

In order to make the optical element more securely connected to the lens holder 21, as shown in FIG. 14, the left and right sides of the supporting member 6 are respectively provided with a fourth clamping leg 84, and each of two fourth clamping legs 84 is located in front of a respective second clamping leg 82, and the low-beam optical element 42 is provided with two fifth clamping legs 85 which are respectively disposed opposite to the two fourth clamping legs 84. As shown in FIG. 15, left and right sides of the lens holder 21 away from the heat sink 1 are respectively provided with one second clamping hole 212, and the fourth clamping leg 84 and the fifth clamping leg 85 located on the same side are stacked and clamped in the second clamping hole 212, so that the supporting member 6 and the low-beam optical element 42 are connected to the lens holder 21.

In order to avoid over-positioning or elastic deformation between the clamping legs and the clamping holes, as shown in FIG. 15, two sides of the first clamping holes 211 and the second clamping holes 212 are provided with openings 213, and two openings 213 are distributed in an up-and-down direction. Optionally, the distribution direction of the two openings 213 is perpendicular to an optical axis direction of the low-beam optical element 42.

Figure 6:
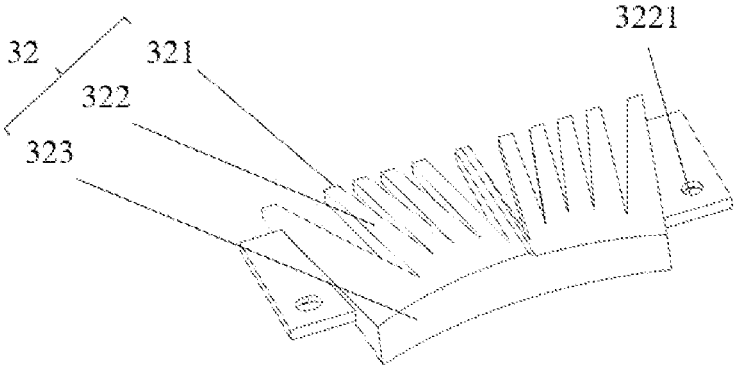
FIG. 6 is a view of a high-beam optical element according to the first embodiment of this application.
Figure 7:
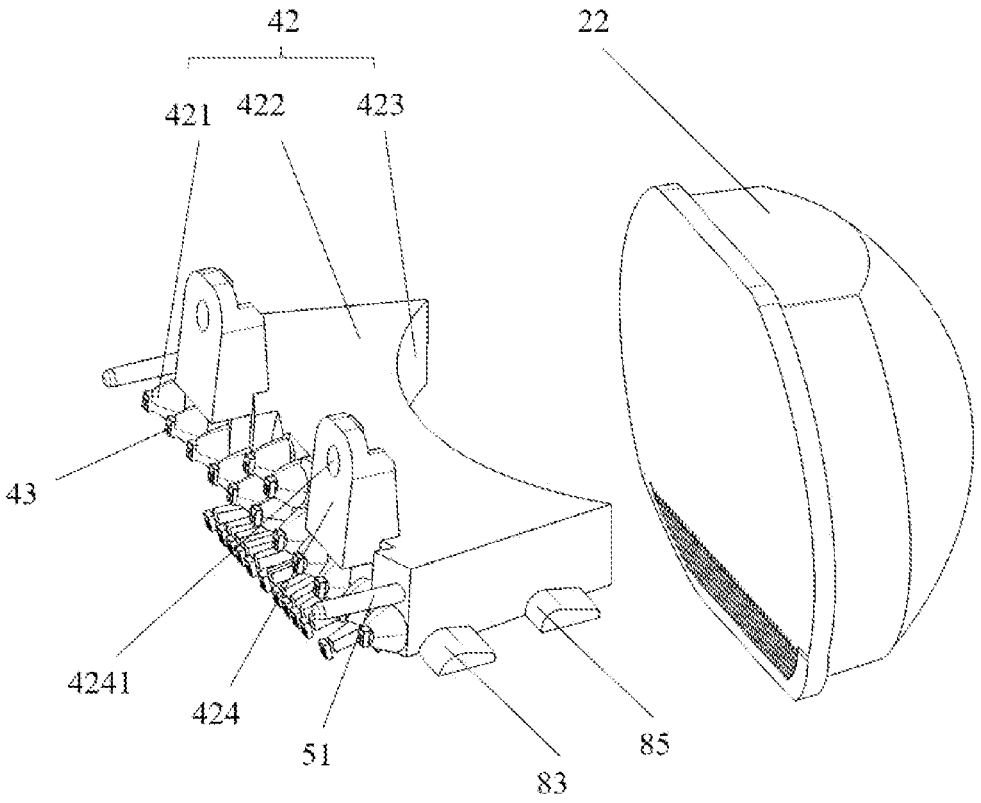
FIG. 7 is a view of part of optical elements (excluding a low-beam circuit board and a high-beam circuit board) in one direction according to the first embodiment of this application.
Figure 8:
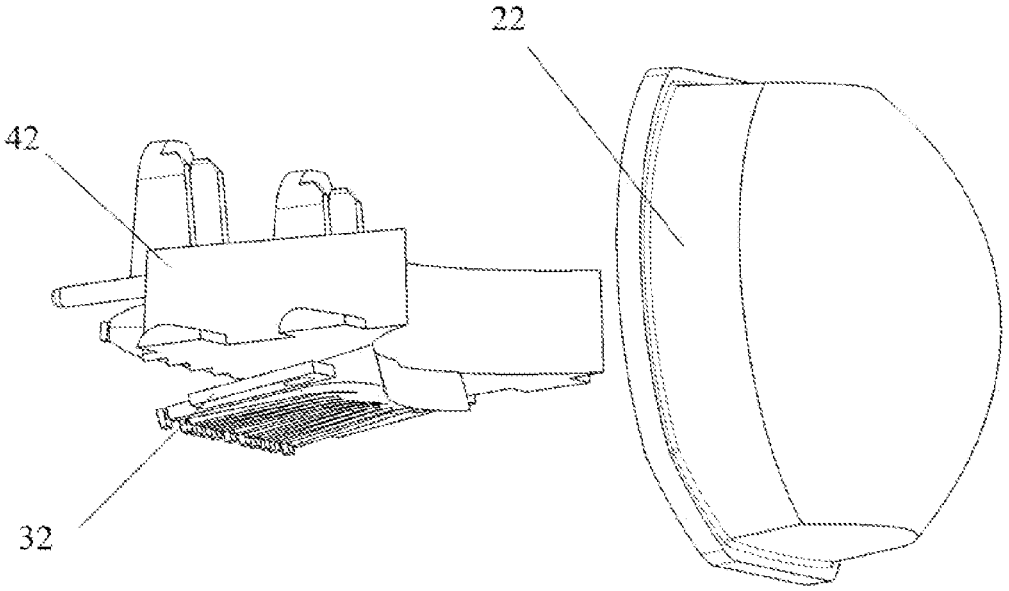
FIG. 8 is a view of part of optical elements (excluding the low-beam circuit board and the high-beam circuit board) in another direction according to the first embodiment of this application.

In an embodiment, the positioning between the supporting member 6, the high-beam optical element 32 and the pressing plate 7 can be achieved by the structure described below. As shown in FIG. 14, a first positioning pin 52 is disposed in the groove 61. As shown in FIG. 6, the high-beam optical element 32 is provided with a first positioning hole 3221 matched with the first positioning pin 52, the pressing plate 7 is provided with a second positioning hole matched with the first positioning pin 52, and the first positioning pin 52 sequentially passes through the first positioning hole 3221 and the second positioning hole to position the supporting member 6, the high-beam optical element 32 and the pressing plate 7, so that the movements of the high-beam optical element 32 and the pressing plate 7 in a front-and-back direction and in a left-and-right direction are limited.

Figure 11:
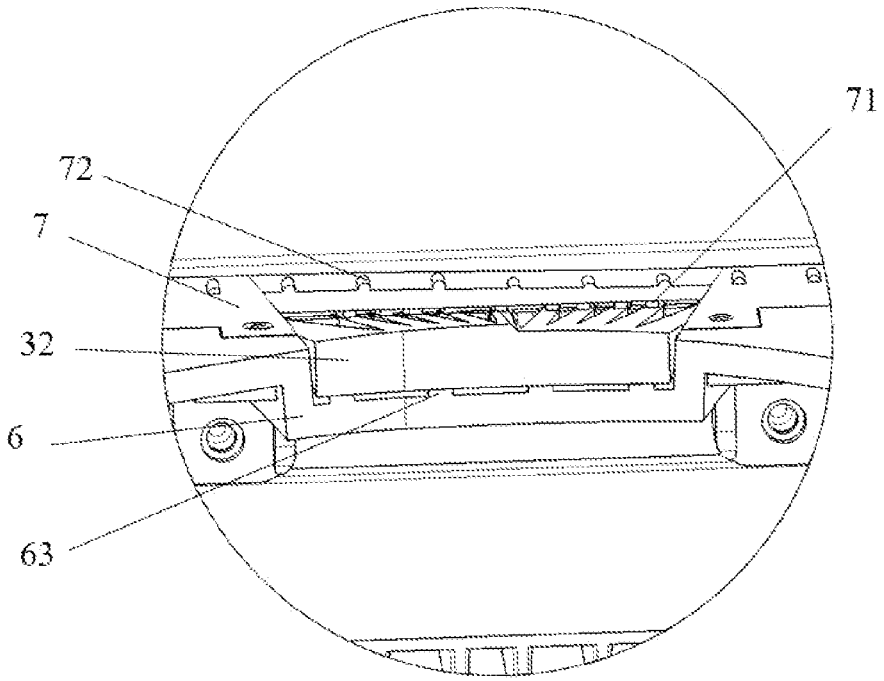
FIG. 11 is a partial enlarged view of FIG. 10 at position B.

In an embodiment, as shown in FIG. 14, a rear end of the groove 61 of the supporting member 6 is provided with a plurality of first positioning protrusions 62, each of the first positioning protrusions 62 is inserted in a gap between two adjacent high-beam light guide bodies to prevent the high-beam optical element 32 from moving in the groove 61. A front end of the groove 61 is provided with second positioning protrusions 63 capable of contacting a lower surface of each of the high-beam light guide bodies. As shown in FIG. 11, a lower surface of the pressing plate 7 is provided with third positioning protrusions 71 capable of contacting an upper surface of each of the high-beam light guide bodies. The second positioning protrusions 63 and the third positioning protrusions 71 can limit the movement of the high-beam optical element 32 in an up-and-down direction. An upper surface of the pressing plate 7 is provided with fourth positioning protrusions 72 capable of contacting a lower surface of the low-beam light guide body to support the low-beam optical element 42.

Figure 9:
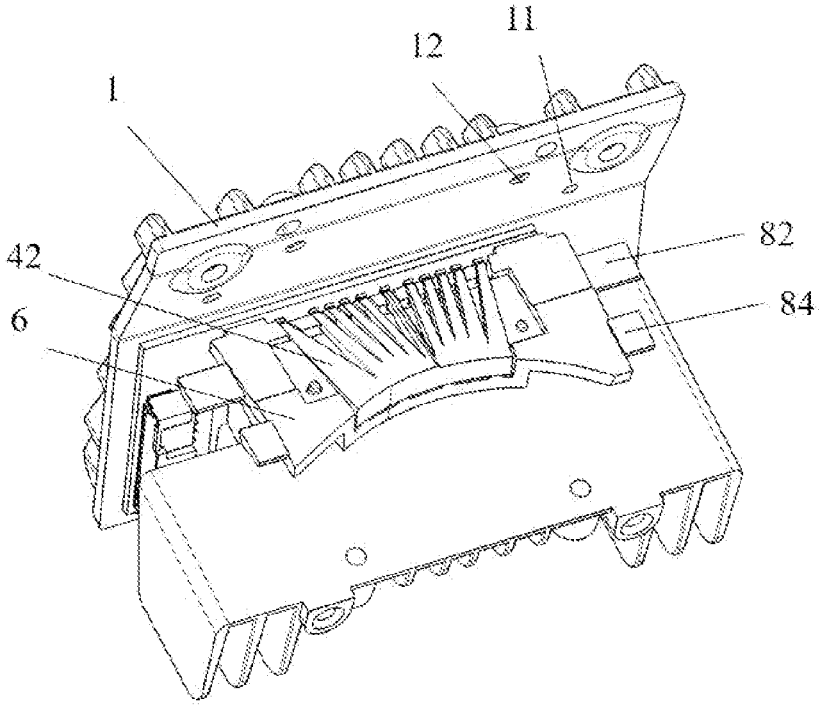
FIG. 9 is a view of part of structures of the lighting module (excluding a lens holder, the lens, the low-beam optical element and a pressing plate) in one direction according to the first embodiment of this application.
Figure 10:
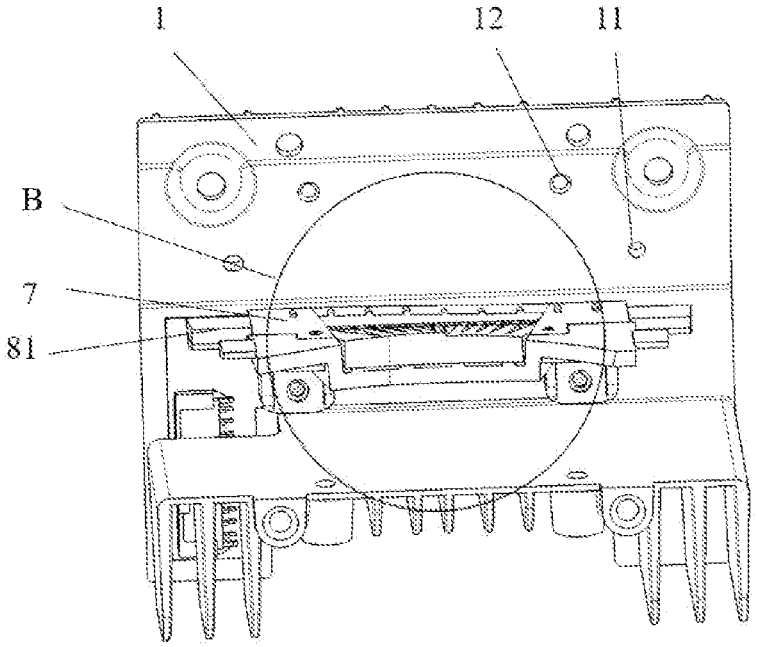
FIG. 10 is a view of part of structures of the lighting module (excluding the lens holder, the lens and the low-beam optical element) in one direction according to the first embodiment of this application.

In an embodiment, the lighting module further includes a heat sink 1 and a low-beam circuit board 41. In order to increase the installation accuracy of the low-beam optical element 42, as shown in FIG. 5, the low-beam optical element 42 is provided with two second positioning pins 51, and the low-beam circuit board 41 is provided with third positioning holes matched with the second positioning pins 51; as shown in FIG. 9, the heat sink 1 is provided with fourth positioning holes 11 matched with the second positioning pins 51, and each of the second positioning pins 51 in sequence passes through a respective third positioning hole and a respective fourth positioning hole 11 to position the low-beam optical element 42, the low-beam circuit board 41 and the heat sink 1, so that the initial positioning of the low-beam optical element 42, the low-beam circuit board 41 and the heat sink 1 can be achieved.

Figure 16:
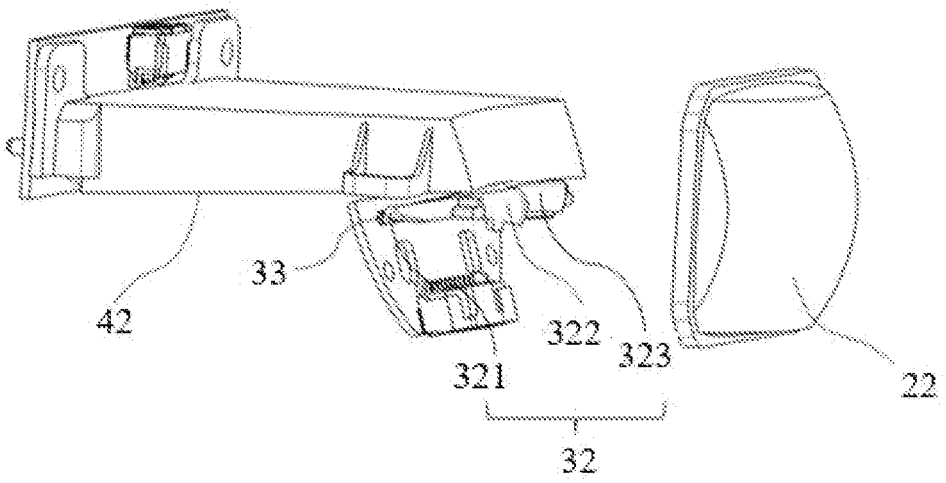
FIG. 16 is a view of a lighting module according to a second embodiment of this application.
Figure 17:
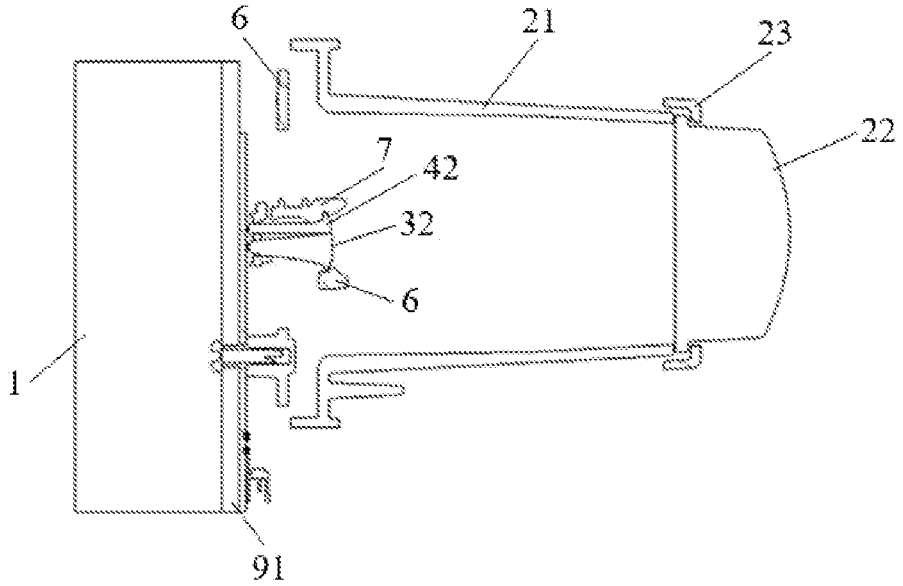
FIG. 17 is a view of a lighting module according to a third embodiment of this application.
Figure 18:
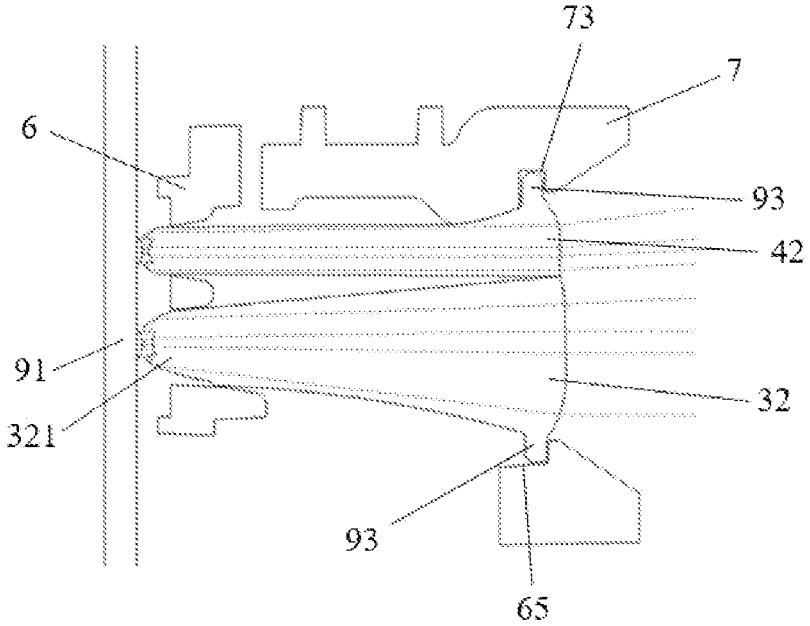
FIG. 18 is a partial enlarged view of FIG. 17.
Figure 19:
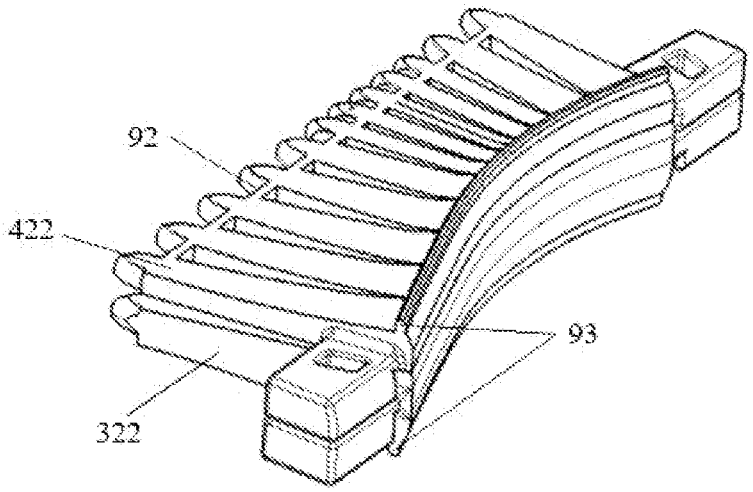
FIG. 19 is a view of optical elements according to the third embodiment of this application.

In an embodiment, as shown in FIG. 6, the high-beam light guide body includes a high-beam light incident part 321 and a high-beam light passing part 322 which are connected in sequence and integrally formed. The high-beam light incident part 321 is a plane, and each of the high-beam light sources 33 is disposed opposite to the high-beam light incident part 321. In other embodiments of this application, the high-beam light incident part 321 may also be an arc-shaped surface protruded in a direction away from the high-beam light passing part 322. For example, as shown in FIG. 16, the high-beam light incident part 321 is a light-concentrating cup structure; a bottom of the light-concentrating cup structure is a plane, or a bottom of the light-concentrating cup structure is provided with a light-concentrating groove and the light-concentrating groove is provided with a protrusion disposed in a direction adjacent to the high-beam light sources 33, which can be configured according to the actual requirements.

In an embodiment, as shown in FIG. 6, the number of the high-beam light passing parts 322 is eleven, and correspondingly, the number of the high-beam light incident parts 321 is eleven, each of the high-beam light passing parts 322 is disposed opposite to one of the high-beam light incident parts 321, each of the high-beam light incident parts 321 is disposed opposite to one of the high-beam light sources 33, and each of the high-beam light sources 33 can be turned on and off individually, so that the anti-glare high beam function can be achieved.

Figure 5:
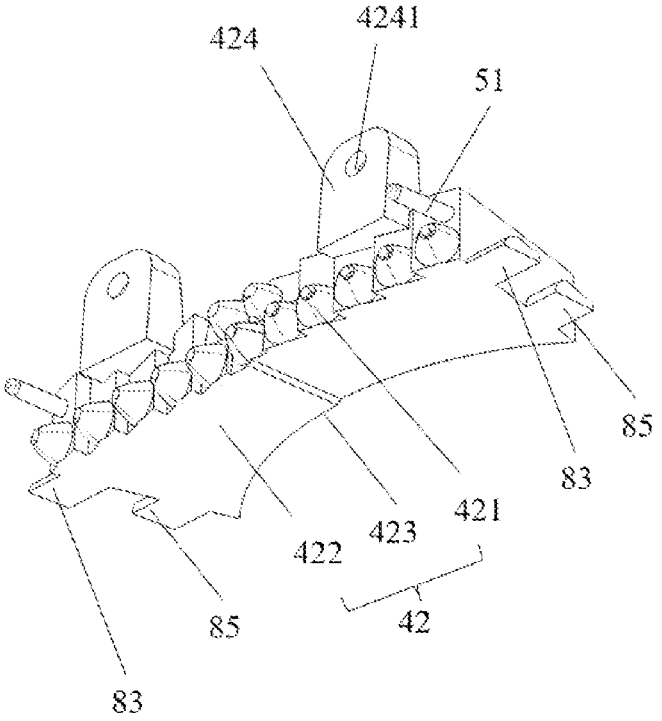
FIG. 5 is a view of a low-beam optical element according to the first embodiment of this application.

Optionally, as shown in FIG. 5, in this embodiment, the low-beam light guide body includes one low-beam light passing part 422 and a plurality of low-beam light incident parts 421 which are s connected in sequence and integrally formed, and the plurality of low-beam light incident parts 421 is disposed at a rear end of the low-beam light passing part 422. In this embodiment, each of the low-beam light incident parts 421 is a light-concentrating cup structure; a bottom of the light-concentrating cup structure is a plane, or the bottom of the light-concentrating cup structure is provided with a light-concentrating groove 61 and the light-concentrating groove 61 is provided with a protrusion disposed in a direction adjacent to the low-beam light sources 43.

In this embodiment, the number of the low-beam light incident parts 421 is thirteen, and the number of the low-beam light passing part 422 is one. The thirteen low-beam light incident parts 421 are disposed in two rows in an up-and-down direction and at a rear end of the low-beam light passing part 422. Two low-beam light incident parts 421 are located in the middle of the upper row, and the other eleven low-beam light incident parts 421 are located in the lower row. In this manner, the lighting intensity of the middle position of the low-beam light shape can be generally greater than the lighting intensity of the side position of the low-beam light shape. In this embodiment, the number of the low-beam light sources 43 is the same as the number of the low-beam light incident parts 421, and each of the low-beam light incident parts 421 is disposed opposite to one of the low-beam light sources 43. In other embodiments of this application, the number of the low-beam light incident parts 421 may be thirteen as in this embodiment, or may be one or at least two, the at least two low-beam light incident parts 421 may be disposed in one row or a plurality of rows, and the number of the low-beam light incident parts 421 in each row may be configured according to the actual requirements.

As shown in FIG. 5, in this embodiment, the low-beam optical element 42 is further provided with two mounting lugs 424, and each of the mounting lugs 424 is provided with a first mounting hole 4241; correspondingly, the low-beam circuit board 41 is provided with a second mounting hole disposed opposite to the first mounting hole 4241, and the heat sink 1 is provided with a third mounting hole 12 disposed opposite to the first mounting hole 4241 and the second mounting hole; during installation, a first fastener 53 passes through in sequence the first mounting hole 4241, the second mounting hole and the third mounting hole 12, so that the secure connection between the low-beam optical element 42, the low-beam circuit board 41 and the heat sink 1 can be achieved. In an embodiment, the first fastener 53 is a screw, a threaded bolt or other fasteners capable of fastening, and can be selected according to the actual requirements.

The lighting module further includes a high-beam circuit board 31. In order to fix the supporting member 6 on the heat sink 1, the supporting member 6 is provided with a fourth mounting hole, the high-beam circuit board 31 is provided with a fifth mounting hole disposed opposite to the fourth mounting hole, and the heat sink 1 is provided with a sixth mounting hole disposed opposite to the fourth mounting hole and the fifth mounting hole; during installation, the second fastener 54 passes through in sequence the fourth mounting hole, the fifth mounting hole and the sixth mounting hole, so that the secure connection between the supporting member 6, the high-beam circuit board 31 and the heat sink 1 can be achieved.

Figure 12:
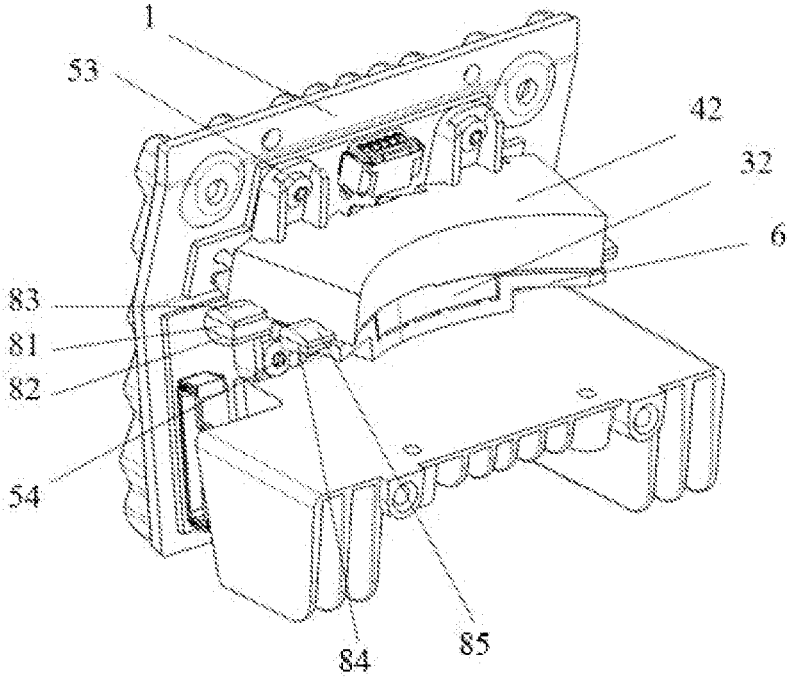
FIG. 12 is a view of part of structures of the lighting module (excluding the lens holder and the lens) in one direction according to the first embodiment of this application.
Figure 13:
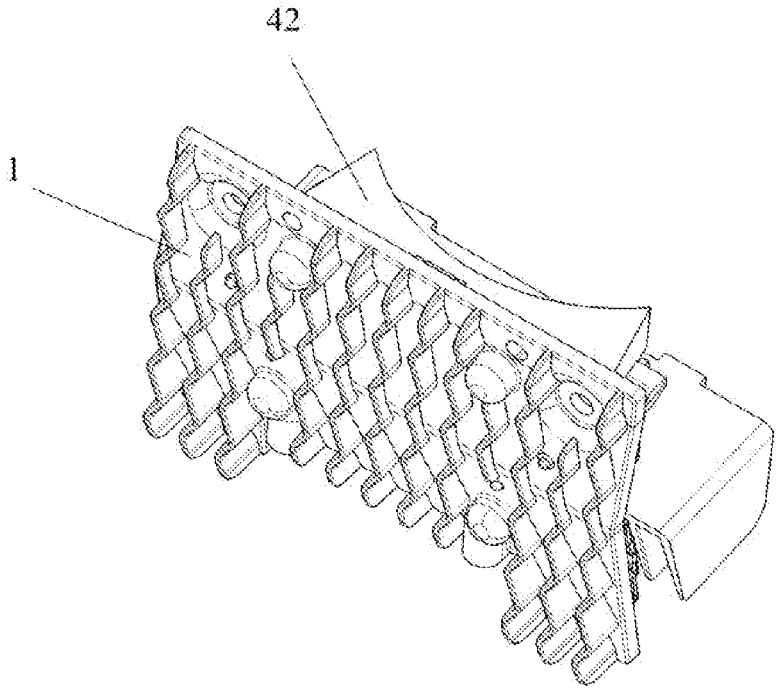
FIG. 13 is a view of part of structures of the lighting module (excluding the lens holder and the lens) in another direction according to the first embodiment of this application.

Optionally, as shown in FIG. 12 and FIG. 13, in this embodiment, the heat sink 1 is a fin-type heat sink, and a space where a cooling fan can be disposed is reserved below the heat sink 1. In the condition where the lighting module integrated with the high beam and the low beam generates more heat, the cooling fan may be disposed below the heat sink 1 to dissipate the heat generated by the lighting module. In other embodiments of this application, in addition to the fin-type heat sink as in this embodiment, the heat sink 1 may also be other forms, and the structure of the heat sink 1 can be configured according to the actual requirements. For example, as shown in FIG. 12 and FIG. 13, most fins of the heat sink 1 are disposed below the supporting member 6 to make full use of the space below the supporting member 6, the length of the fins disposed at a rear side of the heat sink 1 can be greatly reduced, and the fins are wave-shaped to increase the heat dissipation area. Since the fins are disposed below the supporting member 6, in order to facilitate the connection of connectors on the high-beam circuit board 31, the connectors are disposed on a side of the high-beam circuit board 31 rather than below the high-beam circuit board 31, so that the up-and-down dimension of the high-beam circuit board 31 can be reduced.

In this embodiment, the heat sink 1 is securely connected to the optical elements, and the lens 22 is securely connected to the lens holder 21; during installation, it is only necessary to directly connect the lens holder 21 with the lens 22 only needs to be directly connected to the optical elements. In this manner, the installation errors can be greatly reduced, the accuracy of the optical system of the lighting module can be improved, and thus the obtained light shape of the vehicle lamp can also be ideal.

Based on the measurement, a length of the related lighting module in a front-and-rear direction is generally between 130 mm and 160 mm, a length of the related lighting module in an up-and-down direction is generally between 90 mm and 100 mm, and a length of the related lighting module in a left-and-right direction is generally between 90 mm and 100 mm. In this embodiment, the length of the lighting module in the front-and-rear direction is about 90 mm, the length of the lighting module in the up-and-down direction is about 75 mm, and the length of the lighting module in the left-and-right direction is about 95 mm. Compared with the related art, the overall size of the lighting module can be greatly reduced, which facilities the arrangement of the lighting module in the vehicle lamp.

In another embodiment of this application, as shown in FIGS. 17 to 20, the low-beam optical element 42 of the lighting module also includes a plurality of low-beam light guide bodies, rear ends of the plurality of low-beam light guide bodies are separated from one another, front ends of the plurality of low-beam light guide bodies are connected in sequence to form a low-beam light emitting surface 423, and a rear end of each of the low-beam light guide bodies is provided with one low-beam light incident part 421. The low-beam optical element 42 and the high-beam optical element 32 both include a plurality of light guide bodies. Compared with the optical element in the first embodiment, the optical element in this embodiment can achieve more functions. For example, in the case where the low beam is turned on, part of light spots light up to supplement the lighting intensity of the low beam; and in the case where the steering wheel is rotated, the light spots are lit up or went out in sequence in a left-and-right direction along with the steering wheel angle to form the effect of an inflection point moving on the road and serve as a supplementary light for the corner lighting, so that the effect similar to adaptive front-lighting system (AFS) with a motor can be achieved. Multiple structural forms of the low-beam light guide bodies and the high-beam light guide bodies in the preceding implementation may also be adopted in this implementation.

In this embodiment, the lighting module further includes a supporting member 6 and a pressing plate 7, and the high-beam optical element 32 and the low-beam optical element 42 are sandwiched between the supporting member 6 and the pressing plate 7; two rows of rectangular holes 64 are disposed on the supporting member 6, rear ends of the high-beam light guide bodies and rear ends of the low-beam light guide bodies are in one-to-one correspondence with the rectangular holes 64, each of the rear ends of the high-beam light guide bodies can be inserted into a respective rectangular hole 64, and each of the rear ends of the low-beam light guide bodies can be inserted into a respective rectangular hole 64, so that the accuracy of the relative position relationship between each of the high-beam light guide bodies and each of the low-beam light guide bodies can be ensured.

In an embodiment, a separation rib 641 is disposed between the adjacent rectangular holes 64, a connecting rib 92 is disposed between each of the high-beam light guide bodies and each of the low-beam light guide bodies, and the separation rib 641 is capable of contacting the connecting rib 92 to limit the high-beam optical element 32 and the low-beam optical element 42 from moving backward and to ensure the distance between the optical elements and the light sources, and thereby ensuring the luminous efficiency and safety of the vehicle lamp optical system.

In an embodiment, a positioning groove 73 is formed on the pressing plate 7, and a flange 93 matched with the positioning groove 73 is formed at an upper edge of a front end of the low-beam optical element 42; a positioning part 65 is formed on the supporting member 6, and a flange 93 matched with the positioning part 65 is formed at a lower edge of front end of the high-beam optical element 32. On the one hand, a movement of the low-beam optical element 42 in a front-and-rear direction can be limited, and a forward movement of the high-beam optical element 32 can be limited. On the other hand, the pressing plate 7 can press the low-beam optical element 42, so that the lower boundary of the low-beam light emitting surface 423 of the low-beam optical element 42 and the upper boundary of the high-beam light emitting surface 323 of the high-beam optical element 32 are fit.

Figure 20:
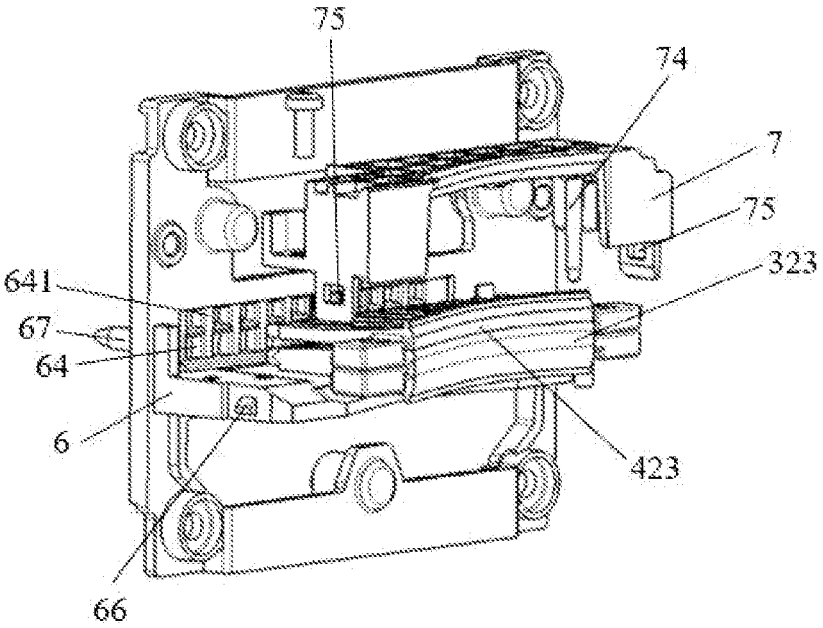
FIG. 20 is an exploded view of the lighting module according to the third embodiment of this application.

As shown in FIG. 20, the pressing plate 7 is provided with a third positioning pin 74, and the supporting member 6 is provided with a fifth positioning hole matched with the third positioning pin 74 to position the pressing plate 7 and the supporting member 6.

In an embodiment, both sides of the pressing plate 7 are provided with a buckle structure 75, and the supporting member 6 is provided with an engaging part 66 that can be matched with the buckle structure 75 so that the pressing plate 7 can be connected to the supporting member 6, and thus the low-beam optical element 42, the high-beam optical element 32, the pressing plate 7 and the supporting member 6 can be securely connected.

In this embodiment, the lighting module further includes a lens 22 and a lens holder 21, the lens 22 is connected to the lens holder 21 through a lens collar 23, the lens holder 21 is connected to the supporting member 6, and the supporting member 6 is connected to a circuit board 91 and the heat sink 1 of this lighting module. In an embodiment, the supporting member 6 is provided with a fourth positioning pin 67, the circuit board 91 and the heat sink 1 are correspondingly provided with a positioning hole, the fourth positioning pin 67 passes through in sequence the positioning hole of the circuit board 91 and the positioning hole of the heat sink 1, and then the supporting member 6, the circuit board 91 and the heat sink 1 are secured through a screw. In this manner, the installation of the circuit board 91 is more convenient, due to a plurality of light sources are disposed on the circuit board 91, in the condition where certain light sources are damaged, the heat sink 1 and the circuit board 91 can be easily removed and replaced.

Optionally, in the preceding embodiments, at least one of the low-beam light emitting surface 423 and the high-beam light emitting surface 323 is an arc-shaped surface recessed in a direction adjacent to the low-beam light sources 43. The arc-shaped surface adapts to an object focal plane of the lens 22, so that the image is made clear.

Optionally, in the preceding embodiments, the high-beam optical element 32 may also include one high-beam light guide body, and the rear end of the high-beam light guide body is provided with a plurality of high-beam light incident parts 321, which can also achieve the integrated function of the high beam and the low beam of the lighting module.

Optionally, in the preceding embodiments, at least one of the low-beam optical element and the high-beam optical element is an optical element with only one light incident surface. The light incident surface is continuous and has no phase differences, the light incident surface shares one light guide body or a plurality of light guide bodies, and the light emitting surface is continuous and has no phase differences.

Therefore, in the preceding embodiments, the multiple manifestations of the light incident part and the light guide body can be combined arbitrarily according to the light shape requirements, all of which can achieve the integrated function of the high beam and the low beam of the lighting module.

In addition, this application further provides a vehicle lamp including the lighting module provided in any one of the preceding solutions.

This application further provides a vehicle including the vehicle lamp provided in the preceding solutions.

The beneficial effects of this application is as follows: compared with the reflector in the related art, the lighting module disclosed in this application has a smaller volume and a more compact structure, so that the requirements of a user can be better satisfied. The heat sink is securely connected to the optical element, and the lens is securely connected to the lens holder. During installation, the lens holder with the lens only needs to be directly connected to the optical element, so that the installation errors can be greatly reduced, the accuracy of the optical system of the lighting module can be improved, and thus the obtained light shape of the vehicle lamp can also be ideal. In addition, the low-beam optical element and the high-beam optical element adopted in this application greatly increase the utilization rate of low-beam light sources and high-beam light sources, the upper boundary of the high-beam light emitting surface of the high-beam optical element and the lower boundary of the low-beam light emitting surface of the low-beam optical element are coincided or a relative small space exists between the upper boundary of the high-beam light emitting surface of the high-beam optical element and the lower boundary of the low-beam light emitting surface of the low-beam optical element, so that a good connection between the low-beam light shape and the high-beam light shape can be ensured and dark areas can be avoided.

What is claimed is:

1. A lighting module, comprising:

a plurality of high-beam light sources;

a plurality of low-beam light sources;

a high-beam optical element, which includes a plurality of high-beam light guide bodies, wherein the plurality of high-beam light guide bodies is in a one-to-one correspondence with the plurality of high-beam light sources, rear ends of the plurality of high-beam light guide bodies are separated from one another, and front ends of the plurality of high-beam light guide bodies are connected in sequence to form a continuous high-beam light emitting surface;

a low-beam optical element, which includes at least one low-beam light guide body, wherein the plurality of low-beam light sources is disposed at a rear end of the at least one low-beam light guide body, and a front end of the at least one low-beam light guide body forms a continuous low-beam light emitting surface, wherein the low-beam optical element and the high-beam optical element are disposed one above the other, an upper boundary of the high-beam light emitting surface and a lower boundary of the low-beam light emitting surface are fit or a spacing distance between an upper boundary of the high-beam light emitting surface and a lower boundary of the low-beam light emitting surface in an up-and-down direction is less than or equal to 2 mm; and a supporting member and a pressing plate, wherein the supporting member is provided with a groove, the high-beam optical element is disposed in the groove, the pressing plate is disposed above the high-beam optical element, and the low-beam optical element is disposed above the pressing plate.

2. The lighting module of claim 1, further comprising a lens holder, wherein the lens holder is provided with a lens, two sides of the pressing plate are respectively provided with a first clamping leg, two sides of the supporting member are respectively provided with a second clamping leg disposed opposite to the first clamping leg, two sides of the low-beam optical element are respectively provided with a third clamping leg disposed opposite to the first clamping leg, the lens holder is provided with clamping holes, and the third clamping leg, the first clamping leg and the second clamping leg located at a same side are stacked in sequence and clamped in a respective one of the clamping holes.

3. The lighting module of claim 2, wherein two sides of each of the clamping holes are respectively provided with an opening.

4. The lighting module of claim 1, wherein the groove is provided with a first positioning pin, the high-beam optical element is provided with a first positioning hole matched with the first position , the pressing plate is provided with a second positioning hole matched with the first positioning pin, and the first positioning pin in sequence passes through the first positioning hole and the second positioning hole to position the supporting member, the high-beam optical element and the pressing plate.

5. The lighting module of claim 1, wherein a rear end of the groove is provided with first position protrusions, each of the first positioning protrusions is inserted between two adj acent ones of the plurality of high-beam light guide bodies, a front end of the groove is provided with second positioning protrusions capable of contacting a lower surface of each of the plurality of high-beam light guide bodies, a lower surface of the pressing plate is provided with third positioning protrusions capable of contacting an upper surface of each of the plurality of high-beam light guide bodies, and an upper surface of the pressing plate is provided with fourth positioning protrusions capable of contacting a lower surface of the at least one low-beam light guide body.

6. The lighting module of claim 1, further comprising a heat sink and a low-beam circuit board, wherein the low-beam optical element is provided with second positioning pins, the low-beam circuit board is provided with third positioning holes matched with the second positioning pins, the heat sink is provided with fourth positioning holes matched with the second positioning pins, and each of the second positioning pins in sequence passes through a respective third positioning hole and a respective fourth positioning hole to position the low-beam optical element, the low-beam circuit board and the heat sink.

7. The lighting module of claim 6, further comprising a high-beam circuit board, wherein the low-beam optical element, the low-beam circuit board and the heat sink are securely connected through a first fastener, and the supporting member, the high-beam circuit board and the heat sink are securely connected through a second fastener.

8. The lighting module of claim 1, wherein each of the plurality of high-beam light guide bodies comprises a high-beam light incident part, the high-beam light incident part is a light-concentrating cup structure, or the high-beam light incident part is a plane.

9. The lighting module of claim 1, wherein the low-beam optical element comprises one low-beam light guide body, and a rear end of the low-beam light guide body is provided with a plurality of low-beam light incident parts.

10. The lighting module of claim 1, wherein the low-beam optical element comprises a plurality of low-beam light guide bodies, rear ends of the plurality of low-beam light guide bodies are separated from one another, front ends of the plurality of low-beam light guide bodies are connected in sequence to form the low-beam light emitting surface, and a rear end of each of the plurality of low-beam light guide bodies is provided with one low-beam light incident part.

11. The lighting module of claim 1, wherein at least one of the low-beam light emitting surface or the high-beam light emitting surface is an arc-shaped surface recessed in a direction closer to the plurality of low-beam light sources.

12. A vehicle lamp, comprising the lighting module of claim 1.

13. A vehicle, comprising the vehicle lamp of claim 12.

14. A lighting module, comprising:

a plurality of high-beam light sources;

a plurality of low-beam light sources;

a high-beam optical element, which includes a plurality of high-beam light guide bodies, wherein the plurality of high-beam light guide bodies is in a one-to-one correspondence with the plurality of high-beam light sources, rear ends of the plurality of high-beam light guide bodies are separated from one another, and front ends of the plurality of high-beam light guide bodies are connected in sequence to form a continuous high-beam light emitting surface;

a low-beam optical element, which includes a plurality of low-beam light guide bodies, wherein a plurality of low-beam light sources is disposed at rear ends of the plurality of low-beam light guide bodies, the rear ends of the plurality of low-beam light guide bodies are separated from one another, front ends of the plurality of low-beam light guide bodies are connected in sequence to form a continuous low-beam light emitting surface, wherein the low-beam optical element and the high-beam optical element are disposed one above the other, an upper boundary of the high-beam light emitting surface and a lower boundary of the low-beam light emitting surface are fit or a spacing distance between an upper boundary of the high-beam light emitting surface and a lower boundary of the low-beam light emitting surface in an up-and-down direction is less than or equal to 2 mm;

a supporting member and a pressing plate, wherein the high-beam optical element and the low-beam optical element are sandwiched between the supporting member and the pressing plate in the up and down direction, the supporting member is provided with two rows of rectangular holes, the rear ends of the plurality of high-beam light guide bodies and the rear ends of the plurality of low-beam light guide bodies are all in one-to-one correspondence with the two rows of rectangular holes to insert each rear end into each rectangular hole; and separation ribs each disposed between each two adjacent rectangular holes of the two rows of rectangular holes, and connecting ribs each disposed between each two adjacent high-beam light guide bodies of the plurality of high-beam light guide bodies and between each two adjacent low-beam light guide bodies of the plurality of low-beam light guide bodies, wherein the separation ribs is capable of contacting the connecting ribs.

15. The lighting module of claim 14, wherein the pressing plate forms a positioning groove, and an upper edge of a front end of the low-beam optical element forms a flange matched with the positioning groove; the supporting member forms a positioning part, and a lower edge of a front end of the high-beam optical element forms the flange matched with the positioning part.

16. The lighting module of claim 14, wherein the pressing plate is provided with a third positioning pin, and the supporting member is provided with a fifth positioning hole matched with the third positioning pin.

17. The lighting module of claim 14, wherein two sides of the pressing plate are provided with a buckle structure, and the supporting member is provided with an engaging part matched with the buckle structure.

18. The lighting module of claim 14, further comprising a lens and a lens holder, wherein the lens is connected to the lens holder through a lens collar, and the lens holder is connected to the supporting member.

19. The lighting module of claim 14, wherein at least one of the low-beam light emitting surface or the high-beam light emitting surface is an arc-shaped surface recessed in a direction closer to the plurality of low-beam light sources.

20. The lighting module of claim 14, wherein each of the plurality of high-beam light guide bodies comprises a high-beam light incident part, the high-beam light incident part is a light-concentrating cup structure, or the high-beam light incident part is a plane.

21. A vehicle lamp, comprising the lighting module of claim 14.

22. A vehicle, comprising the vehicle lamp of claim 21.

* * * * *